US005186424A

United States Patent [19]

Shultz et al.

[11] Patent Number: 5,186,424

[45] Date of Patent: Feb. 16, 1993

[54] BASE FOR A HUMAN SUPPORT APPARATUS

[75] Inventors: Larry D. Shultz, Camarillo; Carl W. Bolton, Ventura, both of Calif.

[73] Assignee: Integrative Motion Systems, Inc., Ventura, Calif.

[21] Appl. No.: 791,368

[22] Filed: Nov. 14, 1991

[51] Int. Cl.[5] ..... F16M 11/12

[52] U.S. Cl. ..... 248/179; 248/425; 248/143; 297/263; 128/33

[58] Field of Search ..... 248/143, 179, DIG. 913, 248/131, 425, 144; 297/263, 272, 258, 259; 128/33; 5/933, 656, 608

[56] References Cited

U.S. PATENT DOCUMENTS

| | | | |
|---|---|---|---|
| 1,241,171 | 9/1917 | Vitulo | 128/33 X |
| 1,338,616 | 4/1920 | Ewing | 248/425 |
| 1,410,476 | 3/1922 | Keane | 128/33 |
| 1,747,543 | 2/1930 | Gregory | 297/263 |
| 2,104,764 | 1/1938 | Sanders et al. | 128/33 |
| 2,446,275 | 8/1948 | Glasin | 128/33 |
| 2,475,289 | 7/1949 | MacGregor | 128/33 |
| 2,696,207 | 12/1954 | Bushnell | 128/33 |
| 2,715,901 | 8/1955 | Blake | 128/33 |
| 3,826,250 | 7/1974 | Adams | 128/33 X |
| 4,057,289 | 11/1977 | Jones | 297/259 |
| 4,544,202 | 10/1985 | Keaton | 248/425 X |
| 4,725,031 | 2/1988 | Simin | 248/425 |
| 4,820,099 | 4/1989 | Negi et al. | 248/425 X |
| 5,022,619 | 6/1991 | Mamada | 248/913 X |

*Primary Examiner*—Carl D. Friedman
*Assistant Examiner*—Korie H. Chan
*Attorney, Agent, or Firm*—Jack C. Munro

[57] ABSTRACT

A base for a human support apparatus such as a bed or a chair which produces a rocking chair type of motion. The base also includes a motor which when driven simultaneously moves the bed or chair in a circular motion within a horizontal plane.

7 Claims, 2 Drawing Sheets

BASE FOR A HUMAN SUPPORT APPARATUS

BACKGROUND OF THE INVENTION

1) FIELD OF THE INVENTION

The field of this invention relates to human support apparatuses such as beds and chairs and more particularly to a base for bed or chair which permits the human occupant of the bed or chair to be slowly moved with a circular motion combined with a rocking motion.

2) DESCRIPTION OF PRIOR ART

Chairs or beds which are mounted on a moveable base have long been known. A perfect example is a rocking chair. A rocking chair will move with just a back and forth type of movement. In the past there have been attempts at constructing a bed or chair to have movement other than a back and forth type of movement. Such bed or chair mechanisms to achieve such movement have been quite complicated in construction. These complicated types of devices have been inherently expensive and tend to be high in maintenance because such have a tendency to break down.

SUMMARY OF THE INVENTION

The primary objective of the present invention is to construct a moving base for a bed or chair which provides for a circular movement in conjunction with a rocking movement which happens to be an exceedingly relaxing type of movement for most human beings.

Another objective of the present invention is to construct a moving base for a bed or chair where the bed or chair can be used in therapy in some medical doctor environments. Another objective of the present invention is to construct a moving base for a bed or chair which is constructed of few parts, simple in construction and operates with a smooth continuous motion which is exceedingly relaxing to almost every individual.

The structure of the present invention includes a platform which is to be fixedly secured to the undersurface of a bed or chair. This platform is to support the weight of the bed or chair and its occupant. This platform is moveably mounted by low frictional rolling means on a frame structure with the platform moveable along an x-axis. The frame structure, in turn, is moveably mounted along a y-axis and is mounted by low frictional rolling means on a pair of bottom wall support members. The y-axis is perpendicular to the x-axis. A motor is connected to the platform and the motor drives the platform in a rotational manner with this rotation being permitted by simultaneous movement of the platform along both the x-axis and the y-axis. The x-axis and y-axis are horizontal. The bottom wall support members are mounted on a convex bottom wall which rest on the supporting surface. This convex bottom wall imparts a separate rocking motion to the platform and to the bed or chair mounted on the platform. The net result is the bed or chair is moved in a rotational horizontal manner with the change in center of gravity of the occupant in conjunction with the bed or chair producing a rocking motion.

DETAILED DESCRIPTION OF THE SHOWN EMBODIMENT

Figure 1:
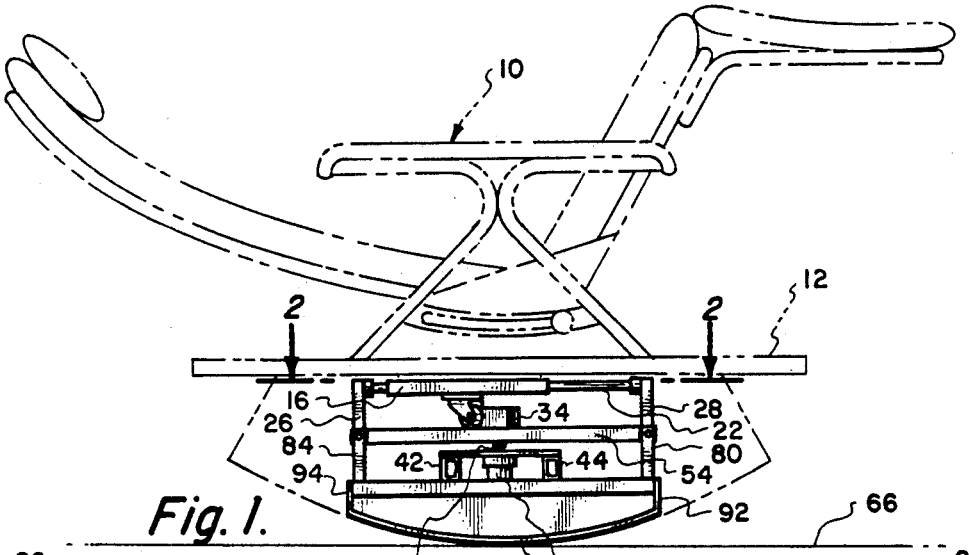
FIG. 1 is a side elevational view of the base of the present invention showing a chair being mounted on the base.
Figure 2:
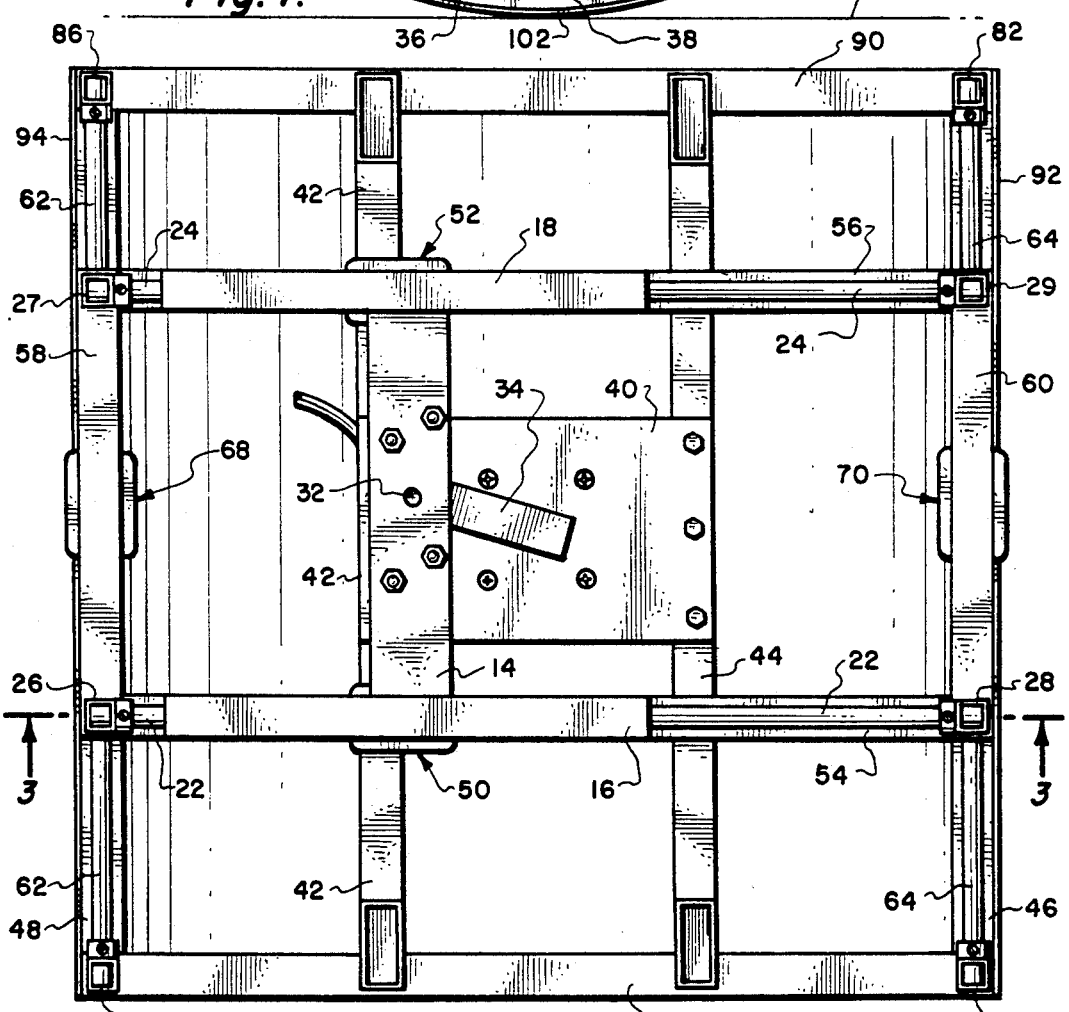
FIG. 2 is a top plan view of the base of the present invention taking along line 2—2 of FIG. 1.
Figure 3:
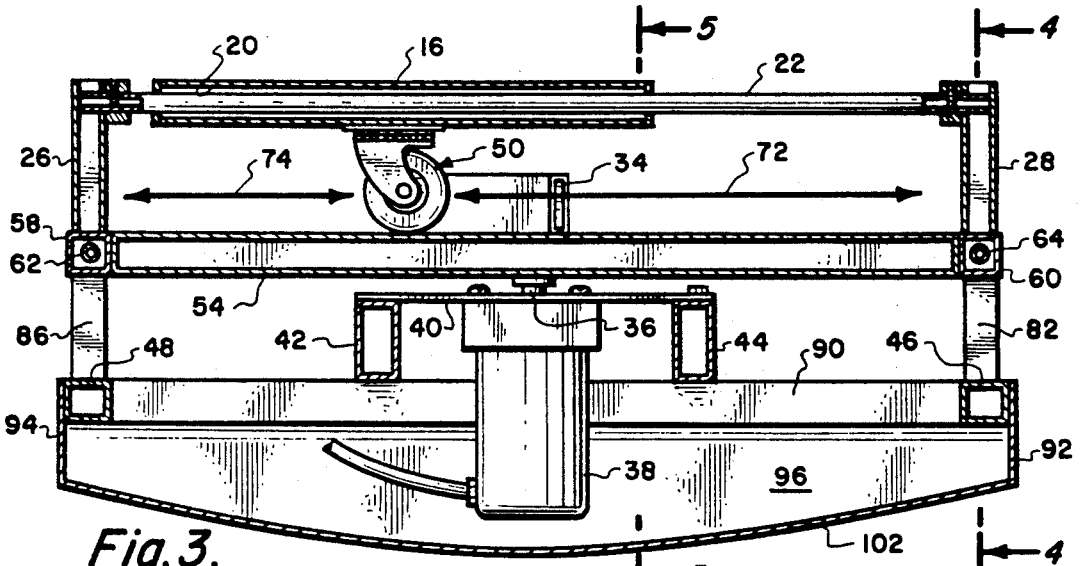
FIG. 3 is a cross-sectional view of the base of the present invention taken along line 3—3 of FIG. 2.
Figure 4:
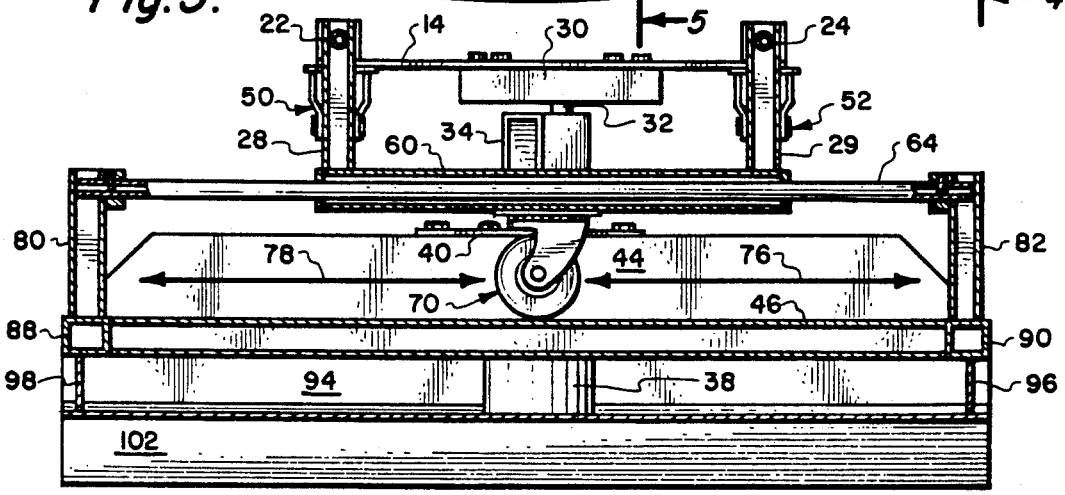
FIG. 4 is a cross-sectional view of the base of the present invention taken in a perpendicular direction to the cross-sectional view of FIG. 3 taken along line 4—4 of FIG. 3.

Referring particularly to the drawings, there is shown a conventional chair 10 which is fixedly mounted on a mounting base 12. This mounting base 12 is fixedly mounted on a platform 14. Typical materials of construction for the platform 14 will be a metal material such as steel or aluminum. Also plastic could be used.

Fixedly mounted on opposite sides of the platform 14 are rails 16 and 18. Each of the rails 16 and 18 are hollow forming a continuous open ended internal chamber 20 for rail 16. Located within the internal chamber 20 and extending entirely through the rail 16 is a rod 22. A similar rod 24 extends through the rail 18. The rods 22 and 24 are mounted parallel and spaced apart. The aligned pair of ends of the rods 22 and 24 ar fixedly mounted to post 26 and 27, respectively. The opposite ends of the rods 22 and 24 are fixedly mounted to posts 28 and 29, respectively.

Mounted on the under surface of platform 14 is a box 30. Pivotaly connected to the box 30 is a pivot pin 32. This pivot pin 32 is also mounted within one end of an arm 34. The opposite end of the arm 34 is mounted to a shaft 36. The shaft 36 extends from a motor mounted within a motor housing 38. The motor housing is fixedly mounted on a mounting plate 40. The mounting plate 40 is supported between a pair of spaced apart beams 42 and 44. The beams 42 and 44 are mounted between bottom frame members 46 and 48 but at a higher elevation.

Fixedly mounted to the under surface of the platform 14 are a pair of low frictional roller assemblies 50 and 52 shown as caster wheels. There could be utilized a spherical type of a ball instead of the caster wheel. Roller assembly 50 rides on cross member 54. Roller assembly 52 rides on a cross member 56. Cross members 54 and 56 are located parallel to each other and are attached at one end to a beam 58 and at the opposite end to a beam 60. Post 26 is mounted on beam 58 and post 28 is mounted on beam 60. The roller assembly 50 moves back and forth on the cross member 54 and roller assembly 52 moves back and forth on cross member 56.

Extending through beam 58 is a rod 62. A similar rod 64 extends through beam 60. Rods 62 and 64 are basically similar to rods 22 and 24 and are also located parallel to each other. Rods 62 and 64 are mounted perpendicular to rods 22 and 24. Also rods 62 and 64 are located underneath rods 22 and 24, that is closer to supporting surface 66. The beam 58 has mounted to its underside a low frictional roller assembly 68. Similar low frictional roller assembly 70 is mounted on the underside of the beam 60. Low frictional roller assemblies 68 and 70 are basically identical to low frictional roller assemblies 50 and 52. Low frictional roller assembly 68 is moveable on frame member 94 with low frictional roller assembly 70 being moveable on frame member 92.

Figure 5:
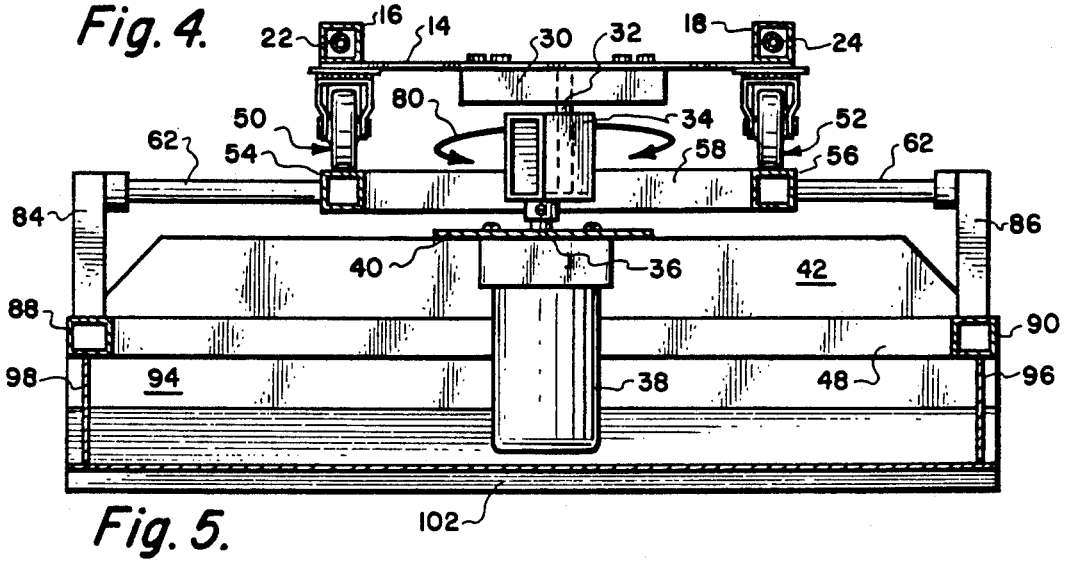
FIG. 5 is a cross-sectional view taken of the base of the present invention taken along line 5—5 of FIG. 3.

The roller assemblies 50 and 52 are moveable along an x-axis depicted by arrows 72 and 74. The limits of movement on the x-axis is determined by the length of the arm 34. The y-axis movement is depicted by arrows 76 and 78. The rotary motion is depicted by arrow 80 in FIG. 5. Therefore, rotating of the motor within motor housing 38 produces the rotary motion depicted by arrow 80 which produces that exact same rotational movement of platform 16 and hence of chair 10. This rotational movement is permitted by the platform 16 moving in an x-axis direction along rods 22 and 24 while simultaneously moving in a y-axis direction on the rods 62 and 64.

The weight of the chair 10 and its occupant is tranferred through the platform 16, the roller assemblies 50 and 52, the cross members 54 and 56 and through roller assemblies 68 and 70 to bottom frame members 46 and 48. This means that the weight of the chair 10 and its occupant is not transferred to the motor within the motor housing 38. This is important so as to keep the motor operating satisfactorily.

One end of rod 64 is fixedly mounted to a post 80. The opposite end of the rod 64 is fixedly mounted to a post 82. In a similar manner, one end of rod 62 is fixedly mounted to a post 84 with the opposite end of the rod 62 being fixedly mounted to a post 86. The posts 80 and 84 are fixedly mounted on bottom frame member 88 while posts 82 and 86 are fixedly mounted on bottom frame member 90. Bottom frame members 46 and 48 are welded or otherwise fixedly secured at their ends to the ends of members 88 and 90. The members 88, 90, 46 and 48 form a rectangular or square configuration.

Attached to the outer sidewall of member 46 is a sheet metal cover 92. In a similar manner attached to the outer sidewall of member 48 is a sheet metal cover 94. Interconnecting sheet metal covers 92 and 94 are side plates 96 and 98 with the side plates 96 and 98 being spaced apart and located parallel. Side plate 96 is attached to beam 90 with side plate 98 being attached to beam 88. Mounted on the lower surface of side plates 96 and 98 and covers 92 and 94 is an arcuate or convex bottom wall 102. This bottom wall 102 rests on supportive surface 66.

As arm 34 is rotated and the platform 16 moves in a circular motion, the overall center of gravity of chair 10 and its occupant will be altered which will produce a rocking motion on bottom wall 102 resembling teeter tottering or rocking back and forth on supporting surface 66.

What is claimed is:

1. A base for a human support apparatus comprising:

a platform adapted to be fixedly secured to said human support apparatus;

x-axis movement means connected to said platform, said x-axis movement means permitting said platform to move linearly along an x-axis;

y-axis movement means connected to said platform, said y-axis movement means permitting said platform to move linearly along a y-axis;

motor means connected to said platform, said motor means imparting rotary motion to said platform which produces simultaneous movement of said platform along said x-axis and said y-axis; and a bottom wall, said bottom wall to rest on a supporting surface, said platform and said x-axis movement means and said y-axis movement means and motor means being mounted on said bottom wall, said bottom wall being convex relative to the supporting surface thereby producing a separate rocking motion of said platform on the supporting surface in accordance to variance of the center of gravity of the human located on said platform.

2. The base as defined in claim 1 wherein:

said x-axis movement means being mounted on first low-friction rolling means, said first low-friction rolling means resting on said y-axis movement means.

3. The base as defined in claim 2 wherein:

second low-friction rolling means being connected to said y-axis movement means, said bottom wall being mounted on bottom wall support members, said second low friction rolling means resting on said bottom wall support members.

4. The base as defined in claim 3 wherein:

said rocking motion being confined to a single vertical plane.

5. The base as defined in claim 4 wherein:

said x-axis lying within said single vertical plane.

6. The base as defined in claim 1 wherein:

said rocking motion being confined to a single vertical plane.

7. The base as defined in claim 6 wherein:

said x-axis lying within said single vertical plane.

* * * * *